US011384605B2

(12) United States Patent
Levie

(10) Patent No.: US 11,384,605 B2
(45) Date of Patent: Jul. 12, 2022

(54) GROUND-DOWN TUBULAR FOR CENTRALIZER ASSEMBLY AND METHOD

(71) Applicant: INNOVEX DOWNHOLE SOLUTIONS, INC., Houston, TX (US)

(72) Inventor: Iain Levie, Spring, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 17/029,781

(22) Filed: Sep. 23, 2020

(65) Prior Publication Data

US 2021/0172263 A1 Jun. 10, 2021

Related U.S. Application Data

(60) Provisional application No. 62/945,787, filed on Dec. 9, 2019.

(51) Int. Cl.
*E21B 17/10* (2006.01)
*E21B 19/24* (2006.01)

(52) U.S. Cl.
CPC ..... *E21B 17/1014* (2013.01); *E21B 17/10* (2013.01); *E21B 19/24* (2013.01); *E21B 17/1078* (2013.01)

(58) Field of Classification Search
CPC .. E21B 17/10; E21B 17/1014; E21B 17/1078; E21B 17/1042; E21B 19/24
See application file for complete search history.

(56) References Cited

U.S. PATENT DOCUMENTS

| | | | | |
|---|---|---|---|---|
| 10,058,976 | B2 | 8/2018 | Stamey | |
| 2002/0139537 | A1* | 10/2002 | Young | E21B 17/1028 166/378 |
| 2013/0333531 | A1 | 12/2013 | Koll | |
| 2016/0186505 | A1* | 6/2016 | Roger | B21D 41/04 166/241.6 |
| 2018/0311787 | A1 | 11/2018 | Stamey | |

FOREIGN PATENT DOCUMENTS

| | | | |
|---|---|---|---|
| CN | 108291803 | A | 7/2018 |
| EP | 3156158 | A1 | 4/2017 |
| JP | 2009-080517 | A | 4/2009 |

OTHER PUBLICATIONS

Park, Tae Wook (Authorized Officer), International Search Report and Written Opinion dated Feb. 22, 2022, PCT Application No. PCT/US2021/057542, 10 pages.

* cited by examiner

*Primary Examiner* — Yong-Suk (Philip) Ro
(74) *Attorney, Agent, or Firm* — MH2 Technology Law Group LLP

(57) ABSTRACT

A centralizer assembly includes a tubular comprising a ground-down region and a raised region. A wall thickness of the tubular in the ground-down region is less than a wall thickness of the tubular in the raised region, and the wall thickness of the tubular in the ground-down region is substantially constant as proceeding around the tubular in the ground-down region. The centralizer assembly also includes a centralizer disposed at least partially in the ground-down region.

18 Claims, 5 Drawing Sheets

GROUND-DOWN TUBULAR FOR CENTRALIZER ASSEMBLY AND METHOD

CROSS-REFERENCE TO RELATED APPLICATIONS

This application claims priority to U.S. Provisional Patent Application having Ser. No. 62/945,787, which was filed on Dec. 9, 2019, and is incorporated herein by reference in its entirety.

BACKGROUND

Oilfield tubulars, such as pipes, drill strings, casing, tubing, etc., may be used to transport fluids or to produce water, oil, and/or gas from geologic formations through wellbores. In various stages of wellbore drilling and completion, such tubulars may be positioned within (i.e., "run-in") the wellbore. During run-in, the oilfield tubulars may be maintained in a generally concentric position within the wellbore, such that an annulus is formed between the oilfield tubular and the wellbore (and/or another, surrounding tubular positioned in the wellbore).

Tools known as "centralizers" are employed to maintain this concentricity of the tubular in the wellbore. A variety of centralizers are used, including rigid centralizers, semi-rigid centralizers, and flexible, bow-spring centralizers. Bow-spring centralizers, in particular, are generally formed from two end collars and flexible ribs that extend between the collars. The ribs are expanded outward, and may be resilient, such that the bow-springs centralizers are capable of centralizing the tubular in the wellbore across a range of wellbore sizes.

Restrictions may exist in the wellbore in which the oilfield tubular is run. These restrictions may be areas where the inner diameter of the wellbore is reduced, which, in turn, reduce the clearance between the oilfield tubular and the wellbore. Examples of restrictions include lining hangers, the inner diameter of another, previously-run casing, and the wellhead inner diameter. When restrictions are present, bow-spring centralizers may be employed, and may be configured to collapse radially toward the oilfield tubular, allowing the centralizer to pass through the restrictions, while continuing to provide an annular standoff.

However, bow-spring centralizers generally have an operating envelope for clearance. When the clearance is too small, the bow-spring centralizers may be damaged when passing through the restriction, which may reduce the ability of the centralizers to provide a standoff below the restriction. Furthermore, oilfield tubulars generally include an amount of tolerance for the outer diameter (e.g., 1%), which can make determining the precise clearance size challenging.

SUMMARY

Embodiments of the disclosure provide a centralizer assembly including a tubular having a ground-down region and a raised region. A wall thickness of the tubular in the ground-down region is less than a wall thickness of the tubular in the raised region, and the wall thickness of the tubular in the ground-down region is substantially constant as proceeding around the tubular in the ground-down region. The centralizer assembly also includes a centralizer disposed at least partially in the ground-down region.

Embodiments of the disclosure also provide a method for positioning a centralizer to a tubular. The method includes forming a ground-down region in an outer surface of the tubular. The tubular defines a wall thickness in the ground-down region, and the wall thickness is substantially constant as proceeding around the tubular in the ground-down region. The method also includes positioning a centralizer at least partially in the ground-down region.

Embodiments of the disclosure further provide a centralizer assembly including a tubular having a ground-down region and a raised region. A wall thickness of the tubular in the ground-down region is less than a wall thickness of the tubular in the raised region. The wall thickness of the tubular in the ground-down region is substantially constant as proceeding around the tubular in the ground-down region. The tubular has a non-zero degree of ovality in the ground-down region, and an outer radius of the tubular varies as proceeding around the tubular. The assembly also includes centralizer disposed at least partially in the ground-down region and retained axially therein.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
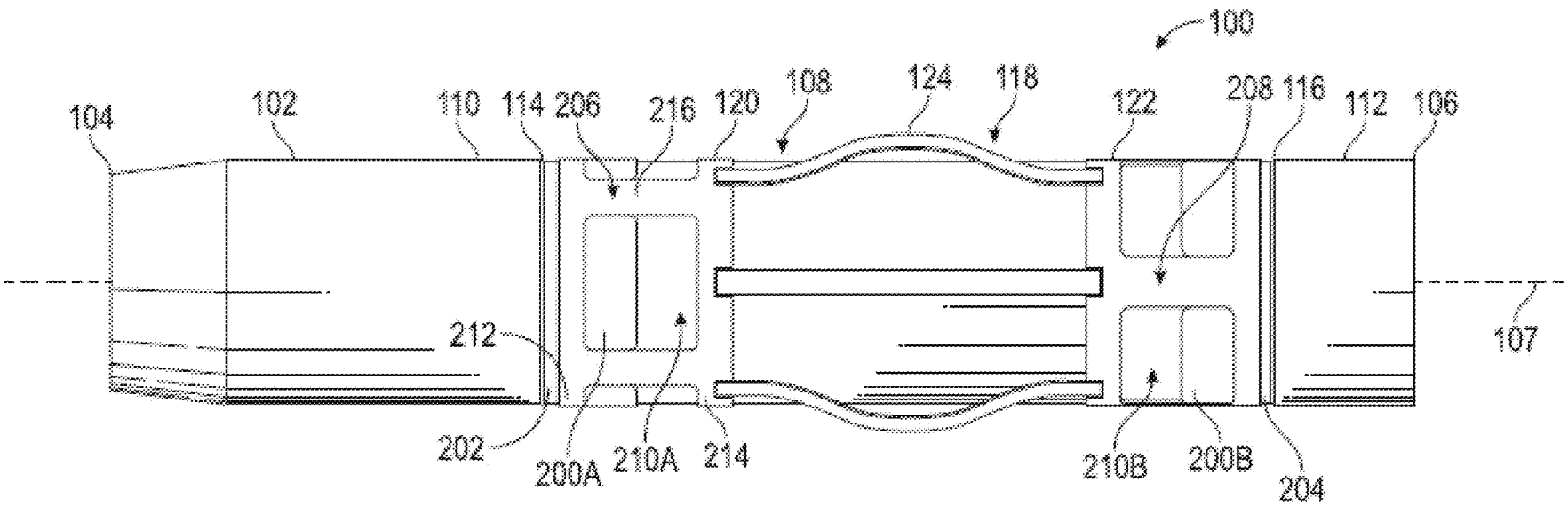
FIG. 1 illustrates a side perspective view of a centralizer assembly, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side perspective view of a centralizer assembly 100, according to an embodiment. The centralizer assembly 100 may be employed, for example, to maintain an annular clearance between a casing string (or any other type of oilfield tubular) and a surrounding tubular (e.g., another casing or liner, or the wellbore wall in open-hole situations). The centralizer assembly 100 may be affixed to a tubular 102, which may be casing, drill pipe, or any other tubular that may be run into a well.

In some embodiments, the tubular 102 may be formed from the same casing (or tubular) as a remainder of a string to which the centralizer assembly 100 may be attached. Further, the tubular 102 may have a length comparable (e.g., the same, within tolerance, as) the adjacent casing. In a specific embodiment, the length of the tubular 102 (and the other casing) may be about 30 feet (about 9 meters). Moreover, the tubular 102 may be made from the same or a similar material as the remaining casing. In other embodiments, the tubular 102 may be formed from a separate type, material, etc. of pipe, tubing, or the like, and may be longer or shorter than the adjacent casing joints.

Further, the tubular 102 may include a first end 104, a second end 106, and a ground-down region 108 disposed between the first and second ends 104, 106. In an embodiment, the ground-down region 108 may be spaced axially apart (e.g., along a longitudinal axis 107 of the centralizer assembly 100) from the ends 104, 106. In another embodiment, the ground-down region 108 may extend to one of the ends 104, 106. The ends 104, 106 may be configured to be attached to axially-adjacent tubulars. Accordingly, in an embodiment, the first end 104 includes a threaded, pin-end connection, and the second end 106 may include a threaded, box-end connection (not visible in FIG. 1).

The tubular 102 may define a radius R and a wall thickness T. The ground-down region 108 may define an area of the tubular 102 where the radius R and the wall thickness T are reduced. However, the wall thickness T in the ground-down region 108 may remain substantially consistent (e.g., within about 1% to about 5% of consistent). In at least one embodiment, the ground-down region 108 may be created using a grinder such as the hardband removal device disclosed in U.S. Pat. No. 10,058,976 and U.S. Patent Publication No. 2018/311787, which are incorporated herein by reference in their entirety to the extent not inconsistent with the present disclosure.

Further, the ground-down region 108 may be formed as a recess in the tubular 102, and thus may be spaced apart from the ends 104, 106, such that the tubular 102 may define two raised regions 110, 112 having larger radii R and wall thickness T than the ground-down region 108. Shoulders 114, 116 may be defined where the raised regions 110, 112 meet or "transition" to the ground-down region 108. The two raised regions 110, 112 may have the same or different outer diameters, which may both be larger than the outer diameter of the ground-down region 108 and/or may be larger than the oilfield tubulars to which the tubular 102 is connected. In some embodiments, however, one or more of the raised regions 110, 112 may be omitted. For example, in some embodiments, the ground-down region 108 may extend to either one of the ends 104, 106, such that the tubular 102 is "skimmed."

The centralizer assembly 100 may also include a centralizer 118, which may be disposed at least partially in the ground-down region 108. The centralizer 118 may include at least one end collar. In the illustrated embodiment, the centralizer 118 includes two, axially-offset end collars 120, 122. The surfaces of the end collars 120, 122 that face away from one another (i.e., the outboard surfaces) may define the axial "extents" of the centralizer 118. In an embodiment, the end collars 120, 122 may be disposed on opposite ends of the ground-down region 108, e.g., generally adjacent to the shoulders 114, 116, respectively.

The centralizer 118 may also include a plurality of ribs 124 which may extend axially between and be connected with (e.g., integrally or via welding, fasteners, tabs, etc.) the end collars 120, 122. In some embodiments, the ribs 124 may be flexible, and may be curved radially outwards from the end collars 120, 122. Such curved, flexible ribs 124 may be referred to as "bow-springs." In other embodiments, however, the ribs 124 may take on other forms, in shape and/or in elastic properties. In some embodiments, a coating may be applied to the ribs 124, the end collars 120, 122, and/or the tubular 102. The coating may be configured to reduce abrasion to the ribs 124, end collars 120, 122, the tubular 102, the casing (or another surrounding tubular in which the centralizer 118 may be deployed), or a combination thereof. The coating may, for example, also serve to reduce friction, and thus torque and drag forces, in the wellbore.

The centralizer 118 may be formed in any suitable way, from any suitable material. In a specific embodiment, the centralizer 118 may be formed by rolling a flat plate, and then seam welding the flat plate to form a cylindrical blank. The cylindrical blank may then be cut, so as to define the ribs 124 and end collars 120, 122. One such fabrication process may be as described in U.S. Patent Publication No. 2014/0251595, which is incorporated by reference herein in its entirety.

In an embodiment in which the tubular 102 is skimmed (ground down to one of the ends 104, 106), the centralizer 118 may be slid onto the tubular 102 fully assembled. Otherwise, the centralizer 118 may be received laterally onto the tubular 102 at the ground-down region 108 and clamped into place, or temporarily expanded so that it can slide over the non-ground-down region and into the ground-down region 108.

The centralizer assembly 100 may also include a plurality of stop features (e.g., segments) 200A, 200B. The stop segments 200A, 200B may be disposed generally proximal to the shoulders 114, 116, respectively, and may be spaced axially apart from the shoulders 114, 116 so as to define circumferentially-extending channels 202, 204 between the stop segments 200A, 200B and the shoulders 114, 116, respectively. Further, the stop segments 200A may be axially-aligned and separated circumferentially apart so as to define axial channels 206 therebetween. Similarly, the stop segments 200B may be axially-aligned and separated circumferentially apart so as to define axial channels 208 therebetween.

The stop segments 200A, 200B may be positioned between the axial extents of the centralizer 118. In other words, the centralizer 118 may be positioned on both axial sides (i.e., opposing first and second axial sides) of the stop segments 200A, 200B. For example, as shown, the stop segments 200A, 200B may be received at least partially through windows 210A, 210B formed in the end collars 120, 122, respectively.

The end collars 120, 122 may be similar in structure. Referring to the end collar 120 as an example, the end collar 120 may include two offset bands 212, 214, with bridges 216 extending between the bands 212, 214. Adjacent pairs of bridges 216, in addition to the bands 212, 214, may define the windows 210A. The bridges 216 may be configured to slide between, in an axial direction, and bear on, in a circumferential direction, the stop segments 200A. The stop segments 200A and the windows 210A may thus cooperate to permit, as well as limit, an axial and/or circumferential range of motion for the centralizer 118 with respect to the tubular 102. In particular, the bands 212, 214 may be configured to engage the stop segments 200A so as to limit an axial range of motion of the centralizer 118 with respect to the tubular 102.

In some embodiments, the windows 210A may be larger, axially and/or circumferentially (e.g., have a larger axial dimension and/or larger circumferential dimension), than the stop segments 200A received therein. This relative sizing may provide a range of rotational and/or axial movement for the centralizer 118; however, in other embodiments, the windows 210A may be sized to more snugly receive the stop segments 200A, thereby constraining or eliminating movement of the centralizer 118 with respect to the tubular 102.

Moreover, the bands 212, 214 of the end collar 120 may be received into the circumferential channels 202. In some embodiments, engagement between the shoulders 114, 116 and the band 214 may limit an axial range of motion of the centralizer 118 with respect to the tubular 102. For example, an axial range of motion needed to provide for axial expansion of the centralizer 118 during radial collapse of the ribs 124 may be determined, and the spacing of the channels 202, taking into consideration the thickness of the band 214, may be calculated. Further, in some situations, the thickness of the bands 214 may be adjusted.

Figure 2:
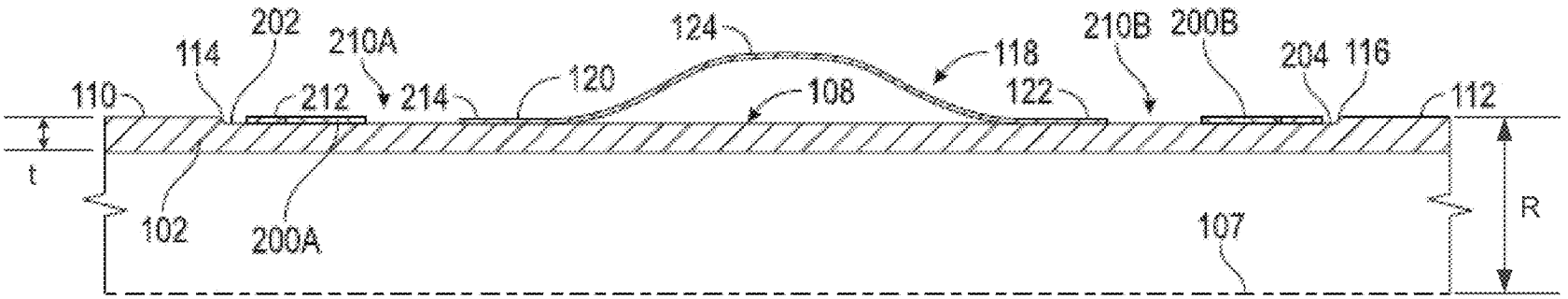
FIG. 2 illustrates a side, cross-sectional view of a portion of a centralizer assembly, according to an embodiment.

FIG. 2 illustrates an enlarged, partial cross sectional view of the centralizer assembly 100, according to an embodiment. As shown, the centralizer assembly 100 includes the tubular 102 defining the raised regions 110, 112 and the ground-down region 108. The shoulders 114, 116, defined where the ground-down region 108 transitions to the raised regions 110, 112, respectively, may be inclined (e.g., beveled), as shown, so as to form an angle with respect to the longitudinal axis 107. For example, as proceeding away from the stop segments 200A, 200B and/or away from the ground-down region 108, the outer diameter of tubular 102 at the shoulders 114, 116 may increase. The shoulders 114, 116 may be inclined so as to reduce stresses in the transition in diameters. In an embodiment, the shoulders 114, 116 may be disposed at an any angle between about 1° and about 90°, for example, at an angle in the range of from about 1°, about 5°, or about 10° to about 20°, about 25°, about 30°. In a specific example, the shoulders 114, 116 may be inclined at an angle of about 15°.

Further, the shoulders 114, 116 may extend at least as far radially as the end collars 120, 122 and/or the stop segments 200A, 200B. That is, the first diameter of the tubular 102 at the raised regions 110, 112 may be at least as large as the second diameter of the tubular 102 in the ground-down region 108 plus twice the thickness of the end collars 120, 122 (or the stop segments 200A, 200B). Accordingly, the raised regions 110, 112 may protect the edges and end faces of the bands 212, 214 and stop segments 200A, 200B from contact with foreign objects in the wellbore. Since the centralizer 118 may be formed from a relatively thin material (e.g., relative to the tubular 102), the protection by the shoulders 114, 116 may assist in preventing damage to the centralizer 118.

The stop segments 200A, 200B may be formed from a material that is different from the material making up the tubular 102 and may be coupled to the tubular 102 in the turned down region 108 using any suitable process. For example, the stop segments 200A, 200B may be formed from one or more layers of a thermal spray, such as WEAR-SOX®, which is commercially available from Innovex Downhole Solutions, Inc. In an embodiment, the thermal spray forming the stop segments 200 may be as described in U.S. Pat. Nos. 7,487,840 or 9,920,412, both of which are incorporated herein by reference in the entirety, to the extent not inconsistent with the present disclosure.

In another embodiment, the stop segments 200A, 200B may be formed from an epoxy injected into a composite shell, such as, for example, described in U.S. Pat. No. 9,376,871, which is incorporated herein by reference in its entirety, to the extent not inconsistent with the present disclosure. For example, in some embodiments, the stop segments 200A, 200B may be formed from an epoxy, a composite, or another molded material connected to the tubular 102.

In still another embodiment, the stop segments 200A, 200B may be made from the same material as the tubular 102 and, e.g., may be integrally-formed therewith. For example, the ground-down region 108 may be formed by grinding around the areas designated for the stop segments 200A, e.g., leaving the channels 202, 206 and forming the shoulder 114. The stop segments 200B and the channels 204, 208 may be similarly formed.

Figure 3:
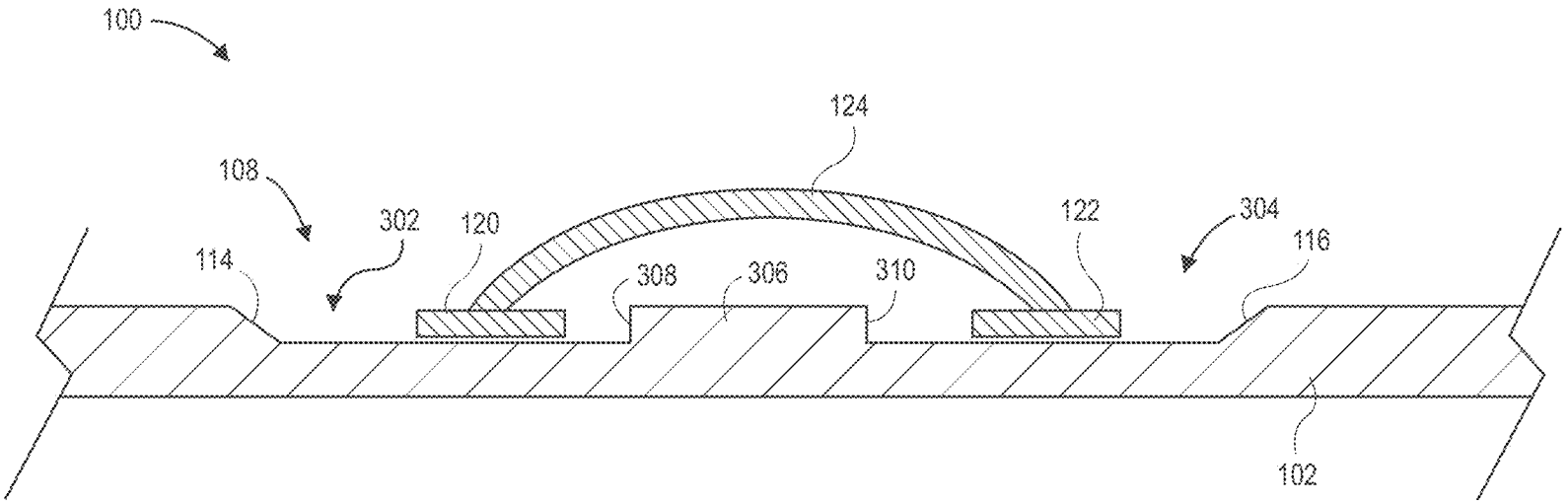
FIG. 3 illustrates a side, cross-sectional view of a portion of another centralizer assembly, according to an embodiment.

FIG. 3 illustrates a side, cross-sectional view of another embodiment of the centralizer assembly 100. In this embodiment, the ground-down region 108 is bifurcated into two ground-down regions 302, 304, which are separated apart axially along the tubular 102 by a medial stop feature (e.g., stop member) 306. The end collars 120, 122 are positioned in the respective ground-down regions 302, 304, as shown, with the ribs 124 extending over the medial stop member 306 and connecting the end collars 120, 122 together. The centralizer 118 may be free to move along a range of motion that is limited by the distance between the shoulder 114 and an end face 308 of the medial stop member 306, and between the shoulder 116 and an end face 310 of the medial stop member 306. This distance may be selected such that the ribs 124 may flex inward to avoid damage in tight restrictions, while flexing outward to engage larger surrounding tubular surfaces. The distances between the end face 308 and the shoulder 114 may be the same or different as the distance between the end face 310 and the shoulder 116, or may be different. Further, the distances may be selected such that the end collar 120 is prevented from engaging the shoulder 114 by the end collar 122 engaging the end face 310, and likewise, the end collar 122 is prevented from engaging the shoulder 116 by the end collar 120 engaging the end face 308. Thus, in at least one embodiment, the provision of the medial stop member 306, in contrast to the stop segments 200A, 200B may result in the centralizer 118 being at least partially pulled through a restriction, rather than being pushed through.

Additionally, in some embodiments, the end faces 308, 310 may be square, so as to provide a generally axially-oriented force couple with the respective end collars 120, 122 upon engagement therewith. This may avoid wedging the end collars 120, 122 radially outwards, as might occur with beveled or angled end faces 308, 310.

The medial stop member 306 may be formed as an integral part of the tubular 102, i.e., a portion that is not ground down or is ground down less than the ground-down regions 302, 304. In another embodiment, the medial stop member 306 may be formed after grinding down the entire length between the shoulders 114, 116, and then depositing a material, such as a thermal spray metal, epoxy-and-shell combination, a separate metal or composite collar, etc., onto the desired location in the ground-down region 108. Further, in some embodiments, the stop member 306 may be partially created by grinding down the adjacent ground-down regions 302, 304. The grinding operation may, however, be constrained to a depth that is insufficient to provide a suitable stop surface; as such, another material may be applied to increase the size of the stop surface. for example, a thermal spray material (e.g., WEARSOX®) may be applied to increase the height of the stop member 306.

Figure 4A:
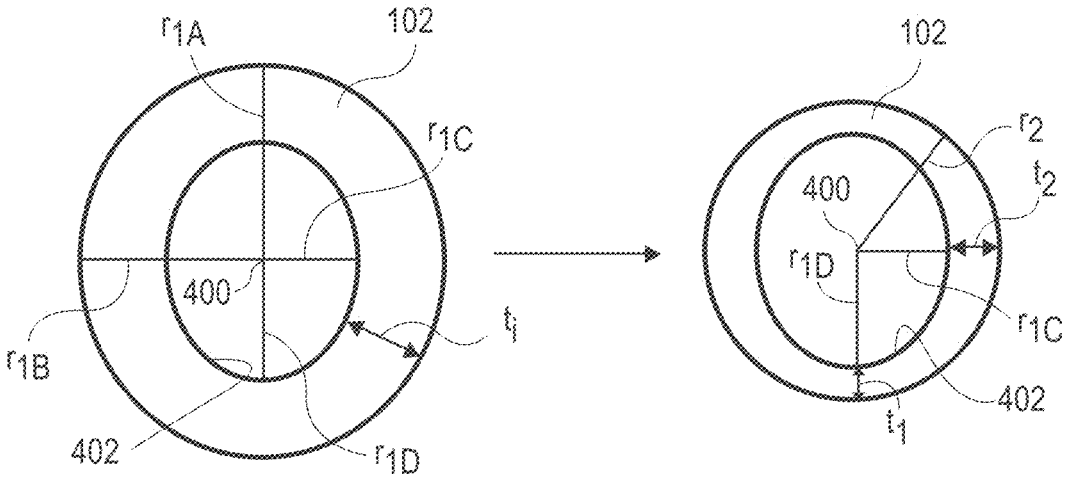
FIG. 4A illustrates a tubular before and after a lathing operation, according to an embodiment.
Figure 4B:
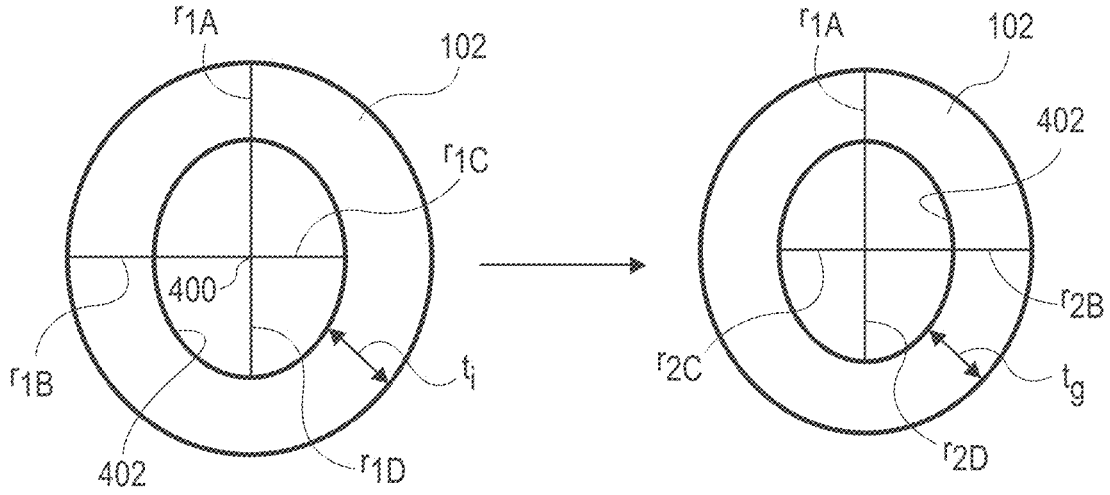
FIG. 4B illustrates a tubular before and after a grinding operation, according to an embodiment.

Before proceeding further with the description, it may be instructive to discuss the difference in grinding the tubular 102 to produce the ground-down region 108, as opposed to using a lathe or another turning/cutting operation to form a reduced-diameter section in a tubular. Reference is made to FIGS. 4A and 4B to aid in an understanding of this difference. FIG. 4A represents an example of a typical lathing operation to reduce an outer diameter of the tubular 102. In such an operation, the tubular 102 is fitted into a chuck, and rotated about its center 400. A cutter (not shown) is held at a static distance $r_2$ from the center 400, such that when the cutting is done, a consistent outer radius $r_2$ for the outside surface results.

However, in many cases, the starting tubular 102 is not precisely round, but has a degree of ovality. Ovality (O) is defined as:

$$O = \frac{2(a-b)}{a+b}$$

where a is the length of the length of the major axis, and b is the length of the minor axis. For most tubulars, the ovality is non-zero.

Thus, as shown in FIG. 4A on the left, an outer radius $r_{1A}$ is larger than an outer radius $r_{1B}$, although both may be larger than radius $r_2$, such that cutting occurs all the way around the tubular 102. The inner radial surface 402 may be likewise ovular, defining radius $r_{1C}$ and radius $r_{1D}$. Before cutting the tubular 102, the tubular 102 may define a wall thickness $t_i$ that is generally uniform all the way around the tubular 102 (i.e., $r_{1A}-r_{1D}=r_{1B}-r_{1C}=t_i$).

After cutting the tubular 102 down to the outer radius $r_2$, however, as shown on the right, the wall thickness may no longer be constant, and may vary between $t_1$ and $t_2$. For example, as shown, $t_1=r_2-r_{1D}<t_2=r_2-r_{1C}$. This may be a consequence of the lathing operation cutting a varying amount of the tubular 102 away as proceeding around the tubular 102, as the ovality is greatly reduced. Creating unintended thin areas in the tubular wall, however, may present a risk to burst failure.

By contrast, a grinding operation may follow the ovality of the tubular 102 and take a consistent amount of material off the tubular 102, all the way around the tubular 102. The result may still reduce the ovality, but to a lesser amount than the lathing, and, more importantly, may result in not changing the consistency of the wall thickness as proceeding around the tubular 102. Referring to FIG. 4B, on the left, the tubular 102 prior to grinding is again shown. After grinding, the outer surface 404 of the tubular 102 defines a varying radius, between a minimum at $r_{2B}$ and a maximum at $r_{2A}$. The thickness tg, however, may remain generally constant (or at least as constant as it was in the tubular 102 prior to grinding), as $r_{2A}-r_{2D}=r_{2B}-r_{2C}=t_g$. Thus, the thickness is reduced from $t_i$ to $t_g$, and no points are thinned to the extent of $t_1$.

It should be appreciated that a lathing operation could, potentially, be used to form the ground-down operation, if the ovality of the tubular 102 could be followed by the lathing operation. However, maintaining a uniform thickness is not inherent to lathing operations, as special care would need to be taken to avoid the uneven thickness discussed above. Likewise, other machining processes, sanding, etc. could be used.

Figure 5:
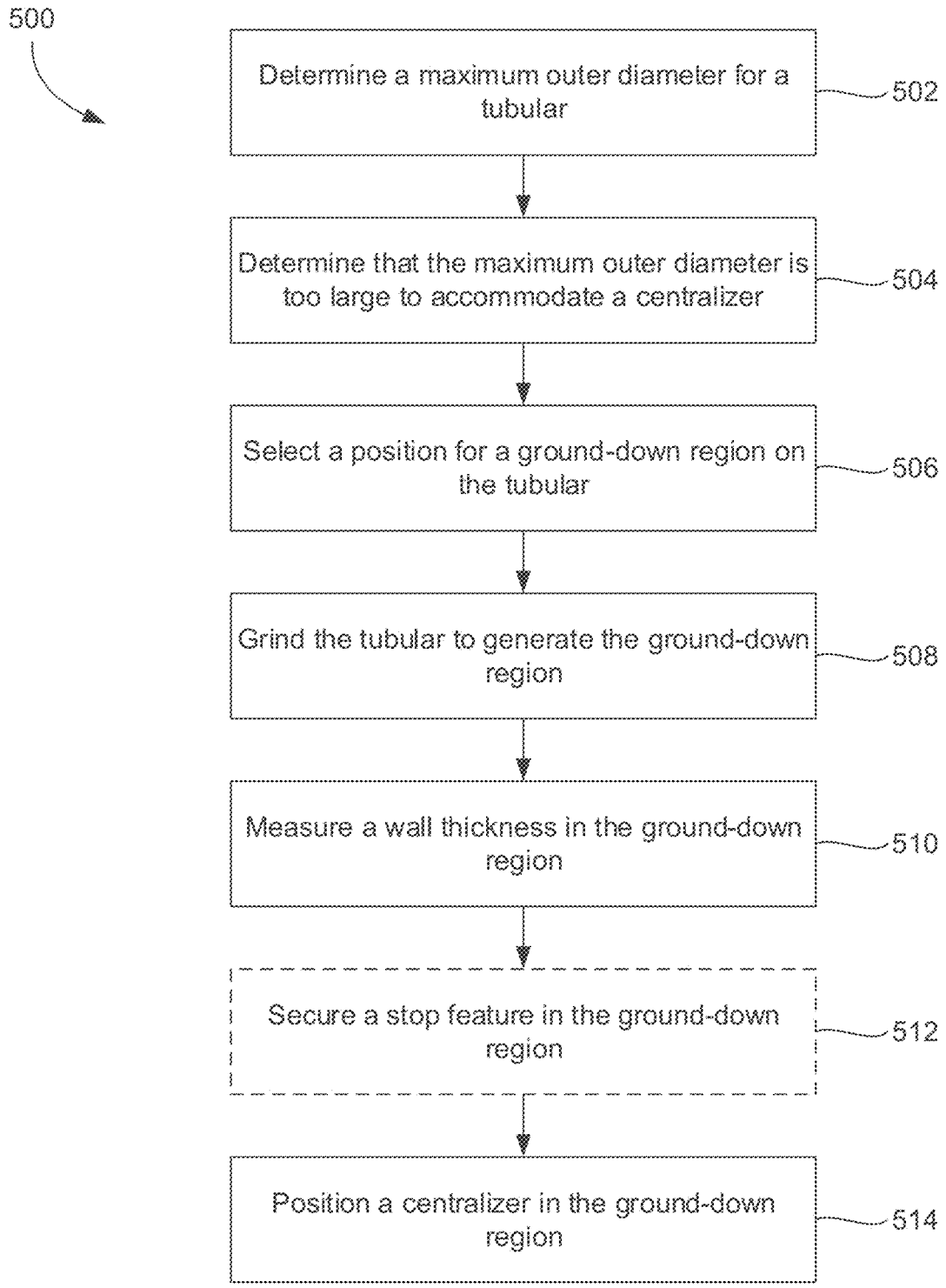
FIG. 5 illustrates a flowchart of a method for grinding down a tubular and attaching a centralizer thereto, according to an embodiment.

FIG. 5 illustrates a flowchart of a method 500 for assembling a centralizer onto a tubular, according to an embodiment. The method 500 is described herein with reference to FIGS. 1-4B, but it will be appreciated that embodiments of the method 500 may employ other structures. Further, the steps disclosed herein for the method 500 may be performed in a different order than presented herein, or may be divided into two or more separate steps, or two or more steps of the method 500 may be combined into a single step.

The method 500 may include determining a maximum outer diameter for a tubular 102 to support a centralizer 118, as at 502. The tubular 102 may be casing, and in particular casing may be configured through smaller and smaller casing diameters as it is deployed farther into a well. The outer diameter of an actual tubular 102 may be "nominal", however, because the tubular 102 is subject to manufacturing tolerances, e.g., about 1%, and may be somewhat ovular (having a varying radius). As such, the tubular 102 may not have a precise, a priori known, geometry and size, but may still be considered to have a nominal size.

The method 500 may also include determining that the maximum outer diameter is too large to accommodate a centralizer 118, as at 504. If the maximum outer diameter of the tubular 102 is too close to the inner diameter of the surrounding tubular (e.g., a casing through which the tubular 102 is deployed) to allow for a centralizer 118, then a ground-down region 108 may be provided to accommodate at least a portion of the thickness of the centralizer 118.

In such circumstances, the method 500 may include selecting a position for the ground-down region 108 of the tubular 102, as at 506. The position may be spaced apart from one or both axial ends of the tubular 102. Moreover, as mentioned above, the ground-down region 108 may actually include two or more regions (e.g., regions 302, 304 as shown in FIG. 3).

The method 500 may then include grinding down the tubular 102 at the ground-down region 108 by a constant amount as proceeding circumferentially around the tubular 102, as at 508. For example, a generally consistent ⅛", 1/16", or any other desired depth may be taken from around the outside of the tubular 102. By contrast, a lathing operation might remove more material in one angular interval than another to bring the tubular 102 closer to a perfect circle.

The method 500 may also include measuring the remaining wall thickness of the tubular 102 in the ground-down region 108, as at 510. This may be achieved using an ultrasonic measuring device, for example, although any suitable measuring device may be employed.

In some embodiments, the method 500 may optionally include securing a stop feature to the tubular 102 in the ground-down region 108, as at 512. In some embodiments, this may be accomplished using a thermal spray material, epoxy-and-shell configuration, or by fastening a metal or composite collar to the tubular 102. In other embodiments, the stop feature may be provided during grinding at 508, e.g., by not grinding or not grinding down as much a particular area of the tubular 102 (e.g., to provide the medial stop member 306). The ground-down region 108 may extend to an end of the tubular 102, ("skimmed") or may be recessed therein.

The method 500 may also include positioning a centralizer 118 at least partially in the ground-down region 108, as at 514. In a skimmed embodiment of the tubular 102, such positioning of the centralizer 118 may be accomplished by sliding the fully-assembled centralizer 118 onto the tubular 102 and into position. In an embodiment in which the ground-down region 108 is recessed into the tubular, the centralizer 118 may be received laterally onto the tubular 102 in the ground-down region 108 and/or otherwise expanded and moved into position in the ground-down region 108. Positioning at 514 may occur before, during, or after securing the stop feature in the ground-down region 108. The end collars 120, 122 of the centralizer 118 may be allowed to slide in the ground-down region 108 over a limited range of motion, sufficient to allow the ribs 124 of the centralizer to flex. The use of a bow-spring centralizer is merely an example, however, as in some embodiments, a rigid centralizer may be used and positioned in the ground-down region 108. Such a rigid centralizer would not include flexible bow springs.

Figure 6:
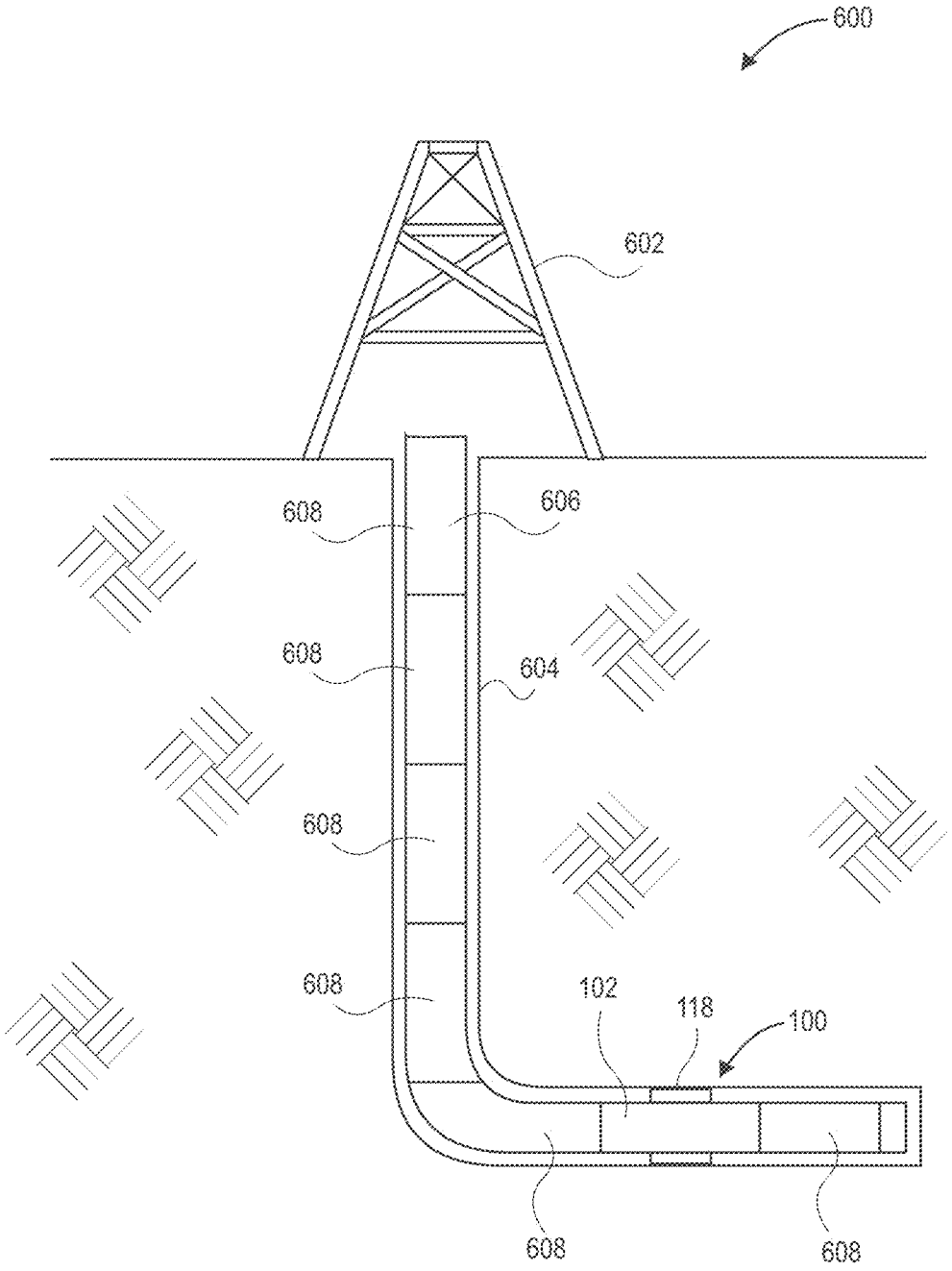
FIG. 6 illustrates a schematic view of a wellsite, according to an embodiment.

FIG. 6 illustrates a side, conceptual view of a wellsite 600, according to an embodiment. The wellsite 600 may include a drilling rig 602, which may have suitable drilling, tubular handling, pumping, etc. equipment to form a well 604. Further, a string 606 of tubulars 608 may be run into the well 604 using the drilling rig 602. The tubulars 608 making up the string 606 may be sections or "joints" of tubulars 608 that are connected together, end-to-end. In some embodiments, the tubulars 608 may be casing, which may be cemented into the well 604. The joints of tubulars 608 may be generally about the same length as one another, e.g., about 10 m in length.

The centralizer assembly 100 may be incorporated in the string 606 of tubulars 608. For example, the tubular 102 of the centralizer assembly 100 may be connected to the tubulars 608, e.g., uphole and downhole of the tubular 102. The tubular 102 may have the same or similar construction as the other tubulars 608 of the string 606. The tubular 102 and the tubulars 608, for example, may each be about 10 m long, be made from a same material (e.g., a steel alloy), have the same nominal diameter, and/or have the same type of end connections. The tubular 102 may differ from the other tubulars 608 of the string 606 in that it includes the ground-down region 108 and/or the other features discussed above and may include the centralizer 118 extending therefrom. Other downhole tools, including other centralizers, may be positioned elsewhere along the string 606.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A centralizer assembly, comprising:

a tubular comprising a ground-down region and a raised region, wherein a wall thickness of the tubular in the ground-down region is less than a wall thickness of the tubular in the raised region, and wherein an outer radius of the tubular varies in the ground-down region as proceeding around the tubular, and an inner radius of the tubular varies in the ground-down region as proceeding around the tubular, such that the wall thickness of the tubular in the ground-down region is substantially constant as proceeding around the tubular in the ground-down region; and a centralizer disposed at least partially in the ground-down region.

2. The centralizer assembly of claim 1, further comprising a stop feature positioned in the ground-down region, wherein the stop feature is configured to engage the centralizer to limit an axial sliding motion thereof.

3. The centralizer assembly of claim 2, wherein the stop feature comprises a thermal spray material, an epoxy-and-shell assembly, or a collar attached to the tubular.

4. The centralizer assembly of claim 1, wherein the tubular comprises a non-zero degree of ovality in the ground-down region.

5. The centralizer assembly of claim 1, wherein the raised region comprises a first raised region that extends from the ground-down region substantially to an end of the centralizer, and wherein the tubular comprises a second raised region that extends from the ground-down region substantially to an opposite end of the centralizer.

6. The centralizer assembly of claim 1, wherein the ground-down region extends to an end of the centralizer.

7. A method for positioning a centralizer to a tubular, comprising:

forming a ground-down region in an outer surface of the tubular, wherein the tubular defines a wall thickness in the ground-down region, wherein forming the ground-down region comprises varying an outer radius of the tubular in the ground-down region as proceeding around the tubular, and wherein an inner radius of the tubular varies in the ground-down region as proceeding around the tubular, such that the wall thickness is substantially constant as proceeding around the tubular in the ground-down region; and positioning a centralizer at least partially in the ground-down region.

8. The method of claim 7, further comprising:

determining a maximum nominal diameter for the tubular based on a smallest nominal inner diameter of a surrounding tubular and a space to accommodate the centralizer; and determining that the maximum nominal diameter for the tubular is smaller than a nominal outer diameter of the tubular, wherein forming the ground-down region is performed in response to determining that the maximum nominal diameter of the tubular is smaller than the nominal outer diameter.

9. The method of claim 7, wherein forming comprises grinding the tubular to form the ground-down region.

10. The method of claim 9, wherein grinding comprises using a fixed grinder and rotating the tubular relative thereto.

11. The method of claim 7, further comprising forming a stop feature in the ground-down region, wherein the stop feature is configured to engage the centralizer to limit an axial sliding motion thereof.

12. The method of claim 11, wherein forming the stop feature comprises spraying a thermal spray material on, securing an epoxy-and-shell assembly on, or attaching a collar to the tubular.

13. The method of claim 7, wherein the tubular comprises a non-zero degree of ovality in the ground-down region.

14. The method of claim 7, wherein forming the ground-down region comprises forming the ground-down region as a recess in the tubular, wherein first and second raised regions extend from the ground-down region to opposite ends of the tubular, and wherein positioning the centralizer comprises receiving the centralizer laterally into the ground-down region or expanding the centralizer to slide over the first raised region or the second raised region and into the ground-down region.

15. The method of claim 7, wherein forming the ground-down region comprises extending the ground-down region to an end of the tubular, and wherein positioning the centralizer comprises sliding the centralizer over the end of the tubular and into the ground-down region.

16. The method of claim 7, wherein the ground-down region is not formed using a lathe.

17. A centralizer assembly, comprising:

a tubular comprising a ground-down region and a raised region, wherein a wall thickness of the tubular in the ground-down region is less than a wall thickness of the tubular in the raised region, wherein the tubular comprises a non-zero degree of ovality in the ground-down region, and wherein an outer radius of the tubular and an inner radius of the tubular both vary as proceeding around the tubular, such that the wall thickness of the tubular in the ground-down region is substantially constant as proceeding around the tubular in the ground-down region; and a centralizer disposed at least partially in the ground-down region and retained axially therein.

18. The centralizer assembly of claim 17, wherein the tubular comprises a casing joint that is configured to connect to a string of casing joints, wherein the casing joint has a length that is substantially the same as one or more individual joints of the string of casing joints.

* * * * *